United States Patent [19]

Sung

[11] Patent Number: 4,536,189

[45] Date of Patent: Aug. 20, 1985

[54] CORROSION INHIBITOR AND MOTOR FUEL COMPOSITION CONTAINING THE SAME

[75] Inventor: Rodney L. Sung, Fishkill, N.Y.

[73] Assignee: Texaco Inc., White Plains, N.Y.

[21] Appl. No.: 604,768

[22] Filed: Apr. 27, 1984

[51] Int. Cl.[3] ..... C10L 1/22

[52] U.S. Cl. ..... 44/56; 252/392; 44/63; 548/138; 548/262; 548/257

[58] Field of Search ..... 44/56, 63, 71; 252/392; 548/138, 262, 257

[56] References Cited

U.S. PATENT DOCUMENTS 3,791,803 2/1974 Andress, Jr. et al. ..... 44/63

4,348,210 9/1982 Sung ..... 44/56

*Primary Examiner*—Y. Harris-Smith

*Attorney, Agent, or Firm*—Robert A. Kulason; James F. Young; James J. O'Loughlin

[57] ABSTRACT

An anti-corrosion additive composition for motor fuels containing a minor amount (i.e., from 1 to 10%) of a short chain aliphatic alcohol that is prepared by reacting substantially equal molar amounts of maleic anhydride and a hydrocarbon-substituted mono primary amine or hydrocarbon-substituted mono primary ether amine to produce a maleamic acid intermediate reaction product followed by (b) reacting said intermediate product of (a) with a substantially equal molar amount of a heterocyclic selected from the group consisting of 5-amino-1,3,4-thiadiazole-2-thiol or benzotriazole, said hydrocarbon-substituted mono primary amine being represented by the formula:

$$R—NH_2$$

in which R is a monovalent hydrocarbyl radical having from about 6 to about 20 carbon atoms or a hydrocarbyl aminoalkylene radical in which the hydrocarbyl group has from 6 to about 20 carbon atoms and in which the divalent alkylene group has from 2 to 3 carbon atoms, and said hydrocarbon-substituted mono primary ether amine being represented by the formula:

$$R—[O(CH_2)_n]_x\left[OCH_2—\underset{\underset{CH_3}{|}}{CH}\right]_y—NH_2$$

in which R is a hydrocarbyl radical having from about 6 to about 20 carbon atoms and when y is 0, x is 1 and n is an integer from 1 to 4 and when x is 0, y has a value of 1 to 10.

7 Claims, No Drawings

CORROSION INHIBITOR AND MOTOR FUEL COMPOSITION CONTAINING THE SAME

BACKGROUND OF THE INVENTION

1. Field of the Invention

This invention relates to a novel reaction product and to a motor fuel composition containing the same, more particularly, to the reaction product of maleic anhydride, a hydrocarbon-substituted mono primary amine or a hydrocarbon-substituted mono primary ether amine and a heterocyclic compound, and to a motor fuel composition containing the same.

As is well known to those skilled in the art, fuel compositions typified by gasoline and alcohols, which are to be considered for commercial use, must possess low corrosion activity. With many fuel compositions containing minor amounts (i.e., from 1–10%) of short chain alcohols, this is not the case. The methanol-gasoline mixture has a high corrosion activity which causes the metallic parts that the fuel mixture comes in contact with to corrode and rust. The corrosion, if left unchecked, would continue to the point where the engine's effective life is shortened considerably. Because of this major drawback, the use of methanol/gasoline has been limited.

It would be desirable to provide an improved methanol/gasoline motor fuel composition which mitigates or overcomes the problems encountered heretofore.

It is the object of the present invention to provide a novel motor fuel additive and motor fuel composition which will prevent or reduce the corrosive nature of a motor fuel that contains a minor amount of short chain alcohols.

INFORMATION DISCLOSURE STATEMENT

Co-assigned U.S. Pat. No. 4,348,210 discloses inhibiting alcohols against corrosion by addition thereto of a reaction product of maleic anhydride and certain alkoxy propyl amines.

Co-assigned U.S. Pat. Nos. 4,144,036; 4,144,034; and 4,290,778 disclose a motor fuel composition containing as an additive a primary hydrocarbyl alkoxy amino alkylene-substituted asparagine.

Co-assigned U.S. Pat. No. 4,207,079 discloses a motor fuel composition containing as an additive a primary aliphatic hydrocarbon amino alkylene-substituted asparagine.

SUMMARY OF THE INVENTION

This invention relates to a novel composition comprising the reaction product of maleic anhydride, a hydrocarbon-substituted mono primary amine or a hydrocarbon-substituted mono primary ether amine and a heterocyclic compound and to a motor fuel composition containing the same which exhibits good anti-corrosion properties. The additive is prepared by (a) reacting substantially equal molar amounts of maleic anhydride and a hydrocarbon-substituted mono primary amine or a hydrocarbon-substituted mono primary ether amine to produce a maleamic acid intermediate reaction product followed by (b) reacting said intermediate product of (a) with a substantially equal molar amount of a heterocyclic nitrogen compound from the class consisting of 5-amino-1,3,4,-thiadiazole-2-thiol and benzotriazole, to produce a anti-corrosion fuel additive, said amine being represented by the formula:

$$R—NH_2,$$

in which R is a monovalent hydrocarbyl radical having from about 6 to about 20 carbon atoms or a hydrocarbyl aminoalkylene radical in which the hydrocarbyl group has from about 6 to about 20 carbon atoms and in which the divalent alkylene group has from about 2 to 3 carbon atoms, and said hydrocarbon-substituted mono primary ether amine being represented by the formula:

$$R—[O(CH_2)_n]_x\left[OCH_2—\underset{\underset{CH_3}{|}}{CH}\right]_y—NH_2,$$

in which R is a hydrocarbyl radical having from about 6 to about 20 carbon atoms and when y is 0, x is 1 and n is an integer from 1 to 4 and when x is 0, y has a value of 1 to 10.

The present invention is also directed to a short chain alcohol containing motor fuel composition having good anti-corrosion properties which motor fuel composition contains a minor amount of at least one of the above compounds.

DESCRIPTION OF THE INVENTION

The additive component of the short chain alcohol e.g. methanol or ethanol containing motor fuel composition of the invention is a reaction product prepared by reacting substantially equal molar amounts of a maleic anhydride and a hydrocarbon-substituted mono primary amine or a hydrocarbon-substituted mono primary ether amine to produce a maleamic acid intermediate reaction product. This intermediate product is then reacted with a substantially equal molar amount of a heterocyclic compound to produce an anti-corrosion reaction product.

The amine reactant which is employed to prepare the prescribed reaction product is of one of two types. One type is represented by the formula:

$$R—NH_2,$$

in which R is a monovalent saturated or unsaturated hydrocarbyl radical of from about 6 to about 20 carbon atoms or a hydrocarbyl amino alkylene radical in which the hydrocarbyl group has from about 6 to about 20 carbon atoms and in which the divalent alkylene group has from about 2 to 3 carbon atoms.

In one type of suitable hydrocarbon-substituted mono primary amine, R is an aliphatic radical having from 10 to 18 carbon atoms. More preferably, R is an aliphatic radical having from 12 to 18 carbon atoms. Amines of this type are sold under the "Armeens" trademark by the Armak Co., and they include Armeen "C" (cocoamine) having a typical chain length distribution ranging from $C_8$ to $C_{18}$ with 51% being saturated $C_{12}$ alkyl groups; Armeen "OL" (oleylamine) having a typical chain length distribution ranging from $C_{12}$ to $C_{18}$ with 76% being oleyl; and Armeen "T" (tallowamine) having a typical chain length distribution ranging from $C_{14}$ to $C_{18}$ with 29% being unsaturated $C_{16}$ groups.

In still another type of suitable hydrocarbon-substituted mono primary amine, R is a hydrocarbyl aminoalkylene radical. Preferably, the hydrocarbyl group comprises an aliphatic group having from 10 to 18 carbon atoms and more preferably from 12 to 18 carbon atoms. Preferably, the divalent alkylene group comprises 3 carbon atoms. Amines of this type are sold under the "Duomeen" trademark by the Armak Co., and they include Duomeen "C" which is the hydrogenated cocoamine adduct of acrylonitrile; Duomeen "T" which is the hydrogenated adduct of tallowamine and acrylonitrile; and Duomeen "O" which is the hydrogenated adduct of an amine and acrylonitrile, wherein the amine is an unsaturated primary amine having about 18 carbon atoms.

The other amine reactant is a hydrocarbon-substituted mono primary ether amine which is represented by the formula:

$$R-[O(CH_2)_n]_x\left[OCH_2-\underset{\underset{CH_3}{|}}{CH}\right]_y-NH_2,$$

in which R is a hydrocarbyl radical having from about 6 to about 20 carbon atoms and when y is 0, x is 1 and n is an integer from 1 to 4 and when x is 0, y has a value of 1 to 10. Preferably, R is an aliphatic radical having from 10 to 16 carbon atoms and when y is 0, x is 1 and n is 2 to 3 and when x is 0, y has a value of 1 to 5. More preferably, R is an aliphatic radical having from 10 to 13 carbon atoms, and when y is 0, x is 1 and n is 3 and when x is 0, y is 2.

Suitable hydrocarbon-substituted mono primary ether amines where y is 0 are sold by Armak Co. under the Armeen EA-13 trademark which has a typical chain length distribution of $C_{13}$ carbon atoms and with n equal to 3; and sold by the Tomah Chemical Co. under the Tomah PA-17 trademark which has a chain length distribution of $C_{10}$ to $C_{13}$ and with n equal to 3.

Suitable hydrocarbon-substituted mono primary ether amines where x is 0 are sold by the Texaco Chemical Co. under the Jeffamine M-300 trademark which has a typical chain length distribution ranging from $C_{10}$ to $C_{12}$ and with y equal to 2.

The maleamic acid intermediate reaction product is then reacted with a heterocyclic nitrogen compound. Suitable heterocyclic nitrogen compounds include 5-amino-1,3,4,-thiadiazole-2-thiol or benzotriazole.

The benzotriazoles which may also be employed include those bearing substituents which do not react in the instant reaction, typified by hydrocarbon or alkoxy groups. Illustrative examples of substituted benzotriazoles include:

4-methyl benzotriazole, 4-methoxy benzotriazole, 5-methyl benzotriazole, 5-methoxy benzotriazole, 6-methyl benzotriazole, 6-methoxy benzotriazole, 7-methyl benzotriazole, 4-n-propyl benzotriazole, 5-cyclohexyl benzotriazole, 6-phenyl benzotriazole, 7-benzyl benzotriazole.

The mercaptothiadiazoles which may also be employed include those bearing substituents on the sulfur and/or nitrogen atoms which do not react in the instant reaction, typified by hydrocarbon groups. Illustrative examples of substituted mercaptothiadiazoles include:

5-methylamino 1,3,4-thiadiazole-2-thiol, 5-ethylamino 1,3,4-thiadiazole-2-thiol, 5-propylamino 1,3,4-thiadiazole-2-thiol, 5-butylamino 1,3,4-thiadiazole-2-thio, 5-amino 1,3,4-thiadiazole-2-methylthiol, 5-amino 1,3,4-thiadiazole-2-ethylthiol, 5-amino 1,3,4-thiadiazole-2-propylthiol, 5-amino 1,3,4-thiadiazole-2-butylthiol.

To prepare the instant reaction product, substantially equal molar amounts of a hydrocarbon-substituted mono primary amine or a hydrocarbon-substituted mono primary ether amine and maleic anhydride are heated for 2 to 4 hours at 75° to 150° C. For the purposes of this invention, maleic anhydride and maleic acid are equivalents. Preferably, the maleic anhydride and the amine are heated in a solvent, such as xylene and hexane, which facilitates the formation of the intermediate. To the mixture containing the maleamic acid intermediate product an equal molar amount of a heterocyclic compound, such as benzotriazole or 5-amino-1,3,4,-thiadiazole-2-thiol, is added and the entire mixture is then heated to effect the reaction. In general, this is done by heating the mixture to the reflux temperature and maintaining it under these conditions for the required length of time. The reaction can generally be completed in from about 0.1 to 10 hours, although longer time may be required for large quantities. After the water is removed from the system, the product is filtered and stripped under a vacuum.

The prescribed anti-corrosion additive reaction product of the invention can be added to a gasoline fuel composition or to a gasoline fuel composition containing a minor amount of a short chain alcohol or mixtures of short chain alcohols in an amount ranging from about 1 to about 200 lbs. per thousand barrels of fuel. The preferred concentration of the additive is from about 5 to about 50 lbs. per thousand barrels of fuel.

The motor fuel in which the anti-corrosion additive composition of the invention is employed is a mixture of hydrocarbons boiling in the gasoline boiling range. This fuel may consist of straight chain or branched chain paraffins, cycloparaffins, olefins, aromatic hydrocarbons, or any mixture of these. The motor fuel can be derived from straight run naptha, polymer gasoline, natural gasoline or from catalytically reformed stocks boiling in the range from about 80° to about 450° F. The composition and octane level of the base fuel are not critical and any conventional motor fuel can be employed in the practice of this invention.

Gasoline-alcohol blends which may be employed typically contain 90 to 95 volume percent of gasoline and 5 to 10 volume percent of a short chain alcohol. A typical gasoline contains 90 volume percent gasoline and 10 volume percent short-chain alcohols. Suitable alcohols include methanol, ethanol, propanol, butanol, tertiary butyl alcohol, and the like.

The gasoline-alcohol compositions of this invention may contain any of the additives generally employed in gasoline. Thus, the fuel composition can contain anti-knock compounds such tetraalkyl lead compounds, anti-icing additives, dyes, and the like.

The examples given below illustrate the novel composition of the invention and its use in a gasoline-alcohol motor fuel composition. Unless otherwise specified, all proportions are given by weight.

EXAMPLE I

Preparation of a Maleic Anhydride, Hydrocarbon-Substituted Mono Primary Ether Amine and 5-Amino-1,3,4,-Thiadiazole-2-Thiol Reaction Product To 98 parts of maleic anhydride dissolved in 172 parts of xylene, 284 parts of decyldioxyisopropylamine (Jeffamine M-300) were added. This mixture was reacted in 100° C. for 2 hours and allowed to cool to room temperature. The reaction product was filtered and to 138 parts (50-50 mixture) of the reaction product and xylene were added 33 parts of 5-amino-1,3,4,-thiadiazole-2-thiol (MTZ). The entire mixture was reacted at the reflux temperature of xylene. After all the water of reaction was distilled off (18 parts water), the heating was stopped and the reaction product was filtered and stripped of the remaining solvent under a vacuum. The predominate product had a molecular weight of 501.5, a TAN of 55.9, a TBN of 111.9 and contained 8.4% nitrogen and 12.8% sulphur.

EXAMPLE II

Preparation of Maleic Anhydride, Hydrocarbon-Substituted Mono Primary Ether Amine and MTZ Reaction Product To 98 parts of maleic anhydride dissolved in 373 parts of xylene, 275 parts of tridecoxypropyleneamine (Armeen EA-13) were added. This mixture was reacted at 100° C. for 2 hours and allowed to cool to room temperature. The reaction product was filtered and to 150 parts (50-50 mixture) of maleamic intermediate reaction product and xylene were added 26.4 parts of MTZ. The entire mixture was reacted at the reflux temperature of xylene. After the water of reaction was distilled off (18 parts water), the heating was stopped and the reaction product was filtered and stripped of the remaining solvent under a vacuum. The predominate product had a molecular weight of 505, a TAN of 55.5, a TBN of 111.1 and contained 11% nitrogen and 12.7% sulphur.

EXAMPLE III

Preparation of a Maleic Anhydride, Hydrocarbon-Substituted Mono Primary Ether Amine and MTZ Reaction Product To 98 parts of maleic anhydride dissolved in 200 parts of xylene, 340 parts of decoxypropyleneamine (Tomah PA-17) were added. This mixture was reacted at 100° C. for 2 hours and allowed to cool to room temperature. The product was filtered and to 155 parts (50-50 mixture) of the maleamic reaction product and xylene were added 33 parts of MTZ. The entire mixture was reacted at the reflux temperature of xylene. After all the water of reaction was distilled off (18 parts water), the heating was stopped and the reaction product was filtered and stripped of the remaining solvent under a vacuum. The predominate product had a molecular weight of 486, a TAN of 57.7, a TBN of 115.4 and contained 11.5% nitrogen and 13.2% sulphur.

EXAMPLE IV

Preparation of a Maleic Anhydride, Hydrocarbon-Substituted Mono Primary Ether Amine and Benzotriazole Reaction Product To 98 parts of maleic anhydride dissolved in 388 parts of xylene, which is heated to 60° C., 289.5 parts of decyldioxyisopropylamine (Jeffamine M-300) were added. This mixture was reacted at 100° C. for 2 hours and allowed to cool to room temperature. To a mixture of 150 parts of the maleamic reaction product and 94 parts xylene were added 24 parts of benzotriazole (BTZ) and the entire mixture was reacted at the reflux temperature of xylene. After all the water of reaction was distilled off (18 parts water), the heating was stopped and the reaction product was filtered and stripped of the remaining solvent under a vacuum. The predominate product had a molecular weight of 488.5, a TAN of 57.4, a TBN of 114.8 and contained 11.5% nitrogen.

EXAMPLE V

Preparation of a Maleic Anhydride, Hydrocarbon-Substituted Mono Primary Ether Amine and BTZ Reaction Product To 98 parts of maleic anhydride dissolved in 373 parts of xylene, which is heated to 60° C., 275 parts of tridecoxypropyleneamine (Armeen EA-13) were added. This mixture was reacted at 100° C. for 2 hours and allowed to cool to room temperature. To 75 parts of the maleamic reaction product, which had been filtered and stripped of solvent, were added 24 parts of BTZ and the entire mixture was reacted at the reflux temperature of xylene. After all the water of reaction was distilled off (18 parts water), the heating was stopped and the reaction product was filtered and stripped of the remaining solvent under a vacuum. The predominate product had a molecular weight of 474, a TAN of 59.2, a TBN of 118.4 and contained 11.8% nitrogen.

EXAMPLE VI

Preparation of a Maleic Anhydride, Hydrocarbon-Substituted Mono Primary Ether Amine and BTZ Reaction Product To 98 parts of maleic anhydride dissolved in 438 parts of xylene, decoxypropyleneamine (Tomah PA-17) were added. This mixture was reacted at 100° C. for 2 hours and allowed to cool to room temperature. The maleamic reaction product was filtered and stripped of the remaining solvent under a vacuum. To 430 parts (50-50) mixture of maleamic reaction product and xylene, 59.5 parts of BTZ were added and the entire mixture was reacted at the reflux temperature of xylene. After all the water reaction was distilled of (18 parts water), the heating was stopped and the reaction product was filtered and stripped of the remaining solvent under a vacuum. The predominate product had a molecular weight of 491, a TAN of 57.1, a TBN of 114.3 and contained 11.4% nitrogen.

EXAMPLE VII

The anti-corrosive properties of the fuel composition of the invention was determined in the Iron Strip Corrosion Test (ISCT).

In this test, an iron strip (12 mm×125 mm×1 mm) is prepared by washing in dilute aqueous hydrochloric acid to remove mill scale, then with distilled water to remove the acid, then with acetone-followed by air drying. The strip is then polished with #100 emery cloth.

The polished strip is totally immersed in 90 ml of the test fuel in a 4 ounce bottle for 15 minutes at room temperature of 20° C. 10 ml of distilled water is added. The bottle is shaken and the sample is maintained for the indicated length of days at a temperature of 90° F. The percent rust on the strip is determined visually.

The base fuel employed for demonstrating the anti-corrosive additive composition of the invention was an unleaded grade gasoline having a research octane number of about 93 and containing about 10% by volume of a 50-50 mixture of tertiary-butyl alcohol and methanol. This gasoline consisted of about 32% aromatic hydrocarbons, 8% olefinic hydrocarbons, and 60% paraffin hydrocarbons and boiled in the range from about 88° F. to about 373° F. Gasoline blends were prepared from the base fuel containing about 10% by volume of a 50-50 mixture of tertiary-butyl alcohol and methanol and mixed with specified amounts of the prescribed fuel additive of the invention. These fuels were then tested to determine the effectiveness of the additive in preventing the formation of rust. The results obtained with a fuel containing the instant additive are set forth in the following tables:

TABLE I

IRON STRIP CORROSION TEST

| Run | Fuel Mixture | Additive Concentration (100 PTB) | % Corrosion After 56 Days | |
|---|---|---|---|---|
| 1 | Unleaded Base Fuel plus 9.5 (volume %) 50/50 t-BA/MeOH | Reaction Product of Example I | Copper | T-1 |
| | | | Brass | 10 |
| 2 | Same | Reaction Product of Example II | Copper | Trace |
| | | | Brass | Trace |
| 3 | Same | Reaction Product of Example III | Copper | T-1 |
| | | | Brass | 10 |
| 4 | Same | No Additive | Copper | 10 |
| | | | Brass | 30 |

TABLE II

IRON STRIP CORROSION TEST

| Run | Fuel Mixture | Additive Concentration (100 PTB) | % Corrosion After 64 Days | |
|---|---|---|---|---|
| 1 | Unleaded Base Fuel plus 9.5 (volume %) 50/50 t-BA/MeOH | Reaction Product of Example IV | Copper | 0 |
| | | | Brass | 0 |
| 2 | Same | Reaction Product of Example V | Copper | 0 |
| | | | Brass | Trace |
| 3 | Same | Reaction Product of Example VI | Copper | 0 |
| | | | Brass | Trace |
| 4 | Same | No Additive | Copper | 10 |
| | | | Brass | 30 |

The above data demonstrate that novel fuel compositions of the invention was effective in reducing the corrosive nature of a gasohol fuel mixture as measured by the ICST Test. There was a substantial improvement in the amount of corrosion demonstrated in those samples having the additive of the invention. For example, in the 64 day test, the unleaded base fuel test sample when left in contact with copper and brass showed a 10 and 30% corrosion, respectively. The same test sample with the addition of the additives of the invention demonstrated a much improved percent corrosion in both cases, namely, 0 to trace amount of corrosion. In the 56 day test, the base fuel sample without any additives demonstrated in the presence of copper and brass a 10 and 30% amount corrosion, respectively. The same fuel sample with the addition of the additives of the invention demonstrated a corrosion level that was significantly lower, namely, trace to 1% for copper and trace to 10% for brass.

What is claimed is:

1. A novel composition prepared by (a) reacting substantially equal molar amounts of maleic anhydride and a hydrocarbon-substituted mono primary amine or a hydrocarbon-substituted mono primary ether amine at a temperature ranging from 75 to 150 C. to produce a maleamic acid intermediate reaction product, and (b) reacting said intermediate product of (a) with a substantially equal molar amount of a heterocyclic compound selected from the group consisting of 5-amino-1,3,4,-thiadiazole-2-thiol and benzotriazole at an elevated temperature to produce said composition, said hydrocarbon-substituted mono primary amine being represented by a formula:

$$R—NH_2$$

in which R is a monovalent hydrocarbyl radical having from about 6 to about 20 carbon atoms or a hydrocarbyl aminoalkylene radical in which the hydrocarbyl group has from 6 to about 20 carbon atoms and in which the divalent alkylene group has from about 2 to 3 carbon atoms, and said hydrocarbon-substituted mono primary ether amine being represented by the formula:

$$R—[O(CH_2)_n]_x\left[OCH_2—\underset{\underset{CH_3}{|}}{CH}\right]_y—NH_2$$

in which R is a hydrocarbyl radical having from about 6 to about 20 carbon atoms and when y is 0, x is 1 and n is an integer from 1 to 4 and when x is 0, y has a value of 1 to 10.

2. The composition of claim 1 wherein R in said hydrocarbon-substituted mono primary amine is an aliphatic radical having from 10 to 18 carbon atoms.

3. A motor fuel composition containing a major amount of hydrocarbons boiling in the gasoline boiling range and an effective amount of the anti-corrosion additive of claim 1.

4. A fuel composition as claimed in claim 3, wherein said fuel consists essentially of a gasoline.

5. A fuel composition as claimed in claim 3, wherein said fuel additionally contains from 1 to 10% of a short chain alcohol.

6. A fuel composition as claimed in claim 5, wherein the alcohols are selected from the group consisting of methanol, ethanol, propanol, butanol, and t-butanol.

7. The composition of claim 3, wherein said anti-corrosion reaction product is present in an amount ranging from about 5 to about 50 lbs. per thousand barrels of fuel mixture.

* * * * *